United States Patent [19]

Fennemann et al.

[11] Patent Number: 4,937,054

[45] Date of Patent: Jun. 26, 1990

[54] METHOD OF REGENERATING $ZRF_4$ PICKLING SOLUTIONS

[75] Inventors: Wolfgang Fennemann, Karben; Erich Minzl, Alzenau; Horst Seidel, Frankfurt, all of Fed. Rep. of Germany

[73] Assignee: Metallgesellschaft Aktiengesellschaft, Frankfurt am Main, Fed. Rep. of Germany

[21] Appl. No.: 316,052

[22] Filed: Feb. 24, 1989

[30] Foreign Application Priority Data

Feb. 24, 1988 [DE] Fed. Rep. of Germany ..... 3805654
Aug. 4, 1988 [DE] Fed. Rep. of Germany ..... 3826499

[51] Int. Cl.[5] ..... C01G 25/04; C01B 9/08; C01B 21/46; C01D 3/02

[52] U.S. Cl. ..... 423/72; 423/390

[58] Field of Search ..... 423/484, 390, 72, 472

[56] References Cited

U.S. PATENT DOCUMENTS 4,105,469 8/1978 Megy et al. ..... 134/13
4,330,342 5/1982 Fennemann et al. ..... 134/13

OTHER PUBLICATIONS

Levenspiel, O. "Chemical Reaction Engineering" 2nd ed. Wiley & Sons N.Y., pp. 93–96 (1972).

*Primary Examiner*—Jeffrey E. Russel
*Assistant Examiner*—Brian M. Bolam
*Attorney, Agent, or Firm*—Herbert Dubno

[57] ABSTRACT

A process is disclosed for the regeneration of pickling solutions which contain $ZrF_4$ by addition of a Na compound in which a charge of the pickling solution to be regenerated is analyzed and heated. The amount of Na required for the regeneration is determined in each case and is admixed with intense stirring. Then the mixture is cooled, the precipitated NaZrF compounds are separated and a regenerated pickling solution is recovered.

26 Claims, 3 Drawing Sheets

50
40
30
20
10
0
0.25
0.5
0.75
50°C
40°C
30°C
20°C
Δ Zr [g/l]
Na [g/l]

METHOD OF REGENERATING $ZRF_4$ PICKLING SOLUTIONS

FIELD OF THE INVENTION

This invention relates to a process of regenerating $ZrF_4$-containing pickling solutions containing:

5 to 60 g/l HF
150 to 400 g/l $HNO_3$
0.06 to 1.0 gl Na and
5 to 50 g/l Zr wherein Na compounds are added, NaZrF compounds are precipitated, the NaZrF compounds are separated and makeup HF, makeup $HNO_3$ and optionally $H_2O$ are added.

BACKGROUND OF THE INVENTION

Such a process has been disclosed in U.S. Pat. No. 4,105,469. In that process, the spent pickling solution used to pickle zirconium or a zirconium alloy is to be regenerated to a Zr content of 3 to 7 g/l by an addition of NaF in an adequate amount. It is desired to precipitate $Na_2ZrF_6$ because $NaZrF_5$ is allegedly precipitated as a gel and can be filtered only with difficulty.

In U.S. Pat. No. 4,330,342, it has been stated that the process known from the U.S. Pat. No. 4,105,469 is rather expensive and can be carried out only with difficulty. It has been stated there that the relatively expensive precipitant must be added in crystalline form to ensure that the pickling solution will not be too strongly diluted and that the process is highly susceptible to an addition of the precipitant in an inadequate or excessive amount. The addition of an expensive amount might result in an excessive residual NaF content so that $Na_2ZrF_6$ might already be precipitated in the pickling bath whereas in case of an addition of an inadequate amount, a gel-like $NaZrF_5 \times H_2O$ would be formed and could be filtered-off only with difficulty. For this reason, it has been proposed to heat the spent pickling solution above 40° C., to add dissolved NaOH as a precipitant, to cool below 20° C. and then to separate by filtration the precipitated $Na_2ZrF_6$. NaOH should be added in such an amount that the fully regenerated pickling solution has a residual Na content of 1 to 3 g/l, preferably 1.5 to 2.5 g/l, and a residual Zr content of 1.5 to 2.5 g/l.

However it has been found that considerable difficulties are involved in the practice of the aforedescribed process. These difficulties are mainly due to the fact that the regenerated pickling solution strongly tends to become supersaturated, which particularly in continuous operation, results in a formation of hard salt deposits throughout the system. Even after a short operating time, the process has to be interrupted because flow paths are clogged by deposits and must be cleaned. An economical regeneration of the pickling solution cannot be achieved.

OBJECT OF THE INVENTION

For this reason, it is an object of the invention to modify and develop the known process so that the regeneration will not be disturbed by uncontrolled precipitation which is due to supersaturation and so that the entire regeneration can be effected with a higher economy.

SUMMARY OF THE INVENTION

In order to accomplish that object, it is proposed to carry out the process described hereinabove in such a manner that (a) a charge of the pickling solution to be regenerated is analyzed for its initial contents of $HF_A$, $HNO_{3A}$, $Na_A$ and $Zr_A$ and is heated to 35° to 75° C., (b) the final contents $Na_E$ and $Zr_E$ desired in the pickling solution to be regenerated are selected and/or calculated, (c) the required amount of Na compound is determined from $Na_Z=0.3(Zr_A-Zr_E)+(Na_E-Na_A)$ and (d) HF is added to the pickling solution to be regenerated at least in such an amount that the resulting total amount of HF is sufficient for transforming the amount of Na compound to be added into NaF, whereafter (e) the amount of Na compound to be added is admixed to the pickling solution to be regenerated and finally (f) the precipitated NaZrF compounds are separated in a manner known per se so that a regenerated pickling solution is obtained.

(Index A: $HF_A$, $HNO_{3A}$, $Na_A$ and $Zr_A$ pickling solution to be regenerated)

(Index E: $Na_E$, $Zr_E$ pickling solution regenerated)

(Index Z: $Na_Z$ Addition)

Various experiences gained in the investigation of trouble which arises while carrying out the process of U.S. Pat. No. 4,330,342, provided a start in developing the process in accordance with the invention.

It has been found that reliable information on the solubility of Zr and Na in the pickling solution cannot be obtained until the sample solutions have been allowed to stand for a relatively long time, because stable equilibria will be established only very slowly in such solution systems. For this reason, a satisfactory regeneration cannot be achieved unless adequate time is available and this will be the case only in batch regeneration whereas the continuous operation that is regarded as desirable in the prior art of U.S. Pat. No. 4,330,342 should not be adopted.

Another recognition was the above-mentioned fact that the regenerated pickling solution strongly tends to be supersaturated. In many cases, it contains much more NaZrF compounds than would correspond to the actual dissolving power. Supersaturation will have the known effect that small disturbances which often cannot be identified, may cause the unstable equilibrium of the solution to change to a more stable phase so that precipitations which cannot be controlled as regards time and location will occur with undesired results.

It has also been recognized that the formation of $NaZrF_5$ compounds need not necessarily result in a gel which can be filtered only with difficulty and that, by changing the temperature and the Na:Zr molar ratio, the conditions can be so adjusted that either $NaZrF_5$ compounds or $Na_2ZrF_6$ compounds will predominate. Under conditions which are equal in other respects, higher temperatures will result in a precipitation mainly of $NaZrF_5$ compounds. Almost only $Na_2ZrF_6$ will be precipitated in the lower temperature range.

Moreover, these two compounds are not the only compounds which are formed. There are presumably a substantial number of highly complex compounds having an Na:Zr ratio between 1 and 2 and the high Na compound $Na_2ZrF_6$ having a molar ratio of 2 and the low Na compound $NaZrF_5$ having a molar ratio of 1 are only partial complexes in the system. For instance, the compound $Na_7Zr_6F_{31}$ has been detected.

Besides, the various NaZrF compounds are subjected to a continual transformation and reorientation. This may explain the fact that the precipitation is slow and that a tendency toward supersaturation exists.

BRIEF DESCRIPTION OF THE DRAWING

The above objects, features and advantages of our invention will become more readily apparent from the following description, reference being made to the accompanying drawing in which.

SPECIFIC DESCRIPTION

Figure 1:
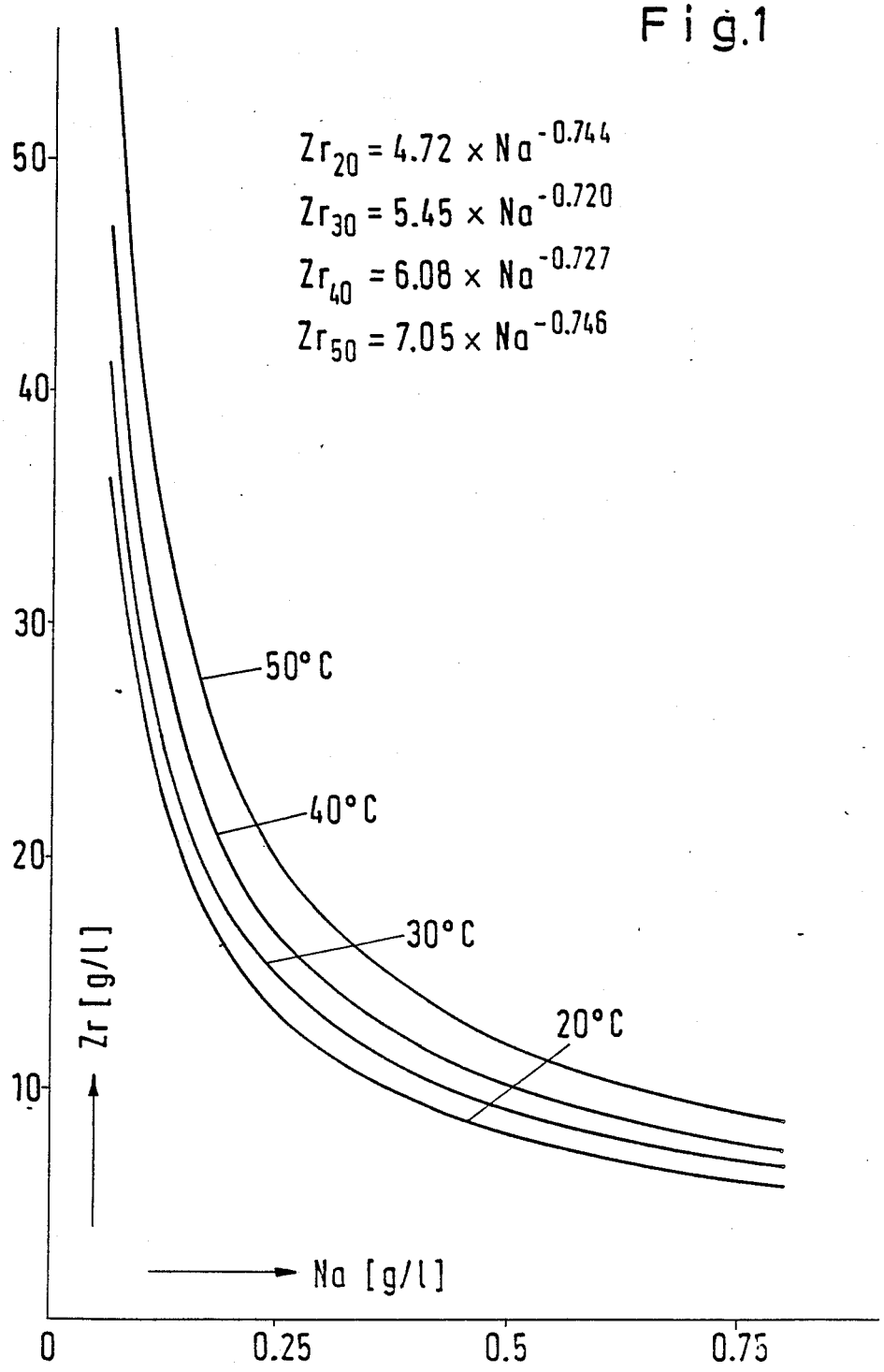
FIG. 1 is a graph in which the solubility of Zr in an equilibrium pickling solution containing 5 mol/l $HNO_3$ and 1 mol/l HF is shown as a function of temperature and Na concentration.

In extensive investigations involving waiting times of several days until a steady state was achieved and also involving an addition of NaZrF salt to avoid supersaturation, it has been determined how much Zr can be dissolved during the pickling in a regenerated pickling solution having residual contents of Na and acid contents of 5 mol/l $HNO_3$ and 1 mol/l HF. Just as the residual Na content, the pickling temperature was varied. By a calculus of observations, the following mathematical functions were derived from the values which had been found:

$Zr_{20} = 4.72 \times Na^{-0.744}$ $Zr_{30} = 5.45 \times Na^{-0.720}$ $Zr_{40} = 6.08 \times Na^{-0.727}$ $Zr_{50} = 7.05 \times Na^{-0.746}$ These functions are represented in FIG. 1 by curves. It is apparent that to a first approximation, the product of the residual Na content and the solubility of Zr is a temperature-dependent constant, i.e., the solubility of Zr will always be higher, the lower is the residual Na content.

The dependence which has been determined for the pickling process is also applicable at least qualitatively to the regenerating process. But whereas a very high solubility of Zr is desired in the pickling process, the residual Zr content of the regenerated pickling solution should be as low as possible so that the pickling should have the highest possible capacity for dissolving Zr. This would mean that the regenerated pickling solution should be adjusted to have a relatively high Na content so that the initial Zr content will be as low as possible for the pickling process. Just these considerations constituted the basis for the process in accordance with U.S. Pat. No. 4,330,342, where residual Na contents of 1 to 3 g/l and residual Zr contents of 1 to 2.5 g/l are desired. A further decrease of the residual Zr content can only be achieved with higher Na content. Whereas this can readily be achieved by an addition of the regenerating agent in a correspondingly larger amount, this will result in an impermissible enriching of Na in the regenerated pickling solution and will adversely affect the pickling process.

As a result, it is found that the pickling process and the regenerating process cannot both be optimized. It is necessary to find a compromise and to adjust the regenerated pickling solution to a residual Na content and a residual Zr content which will be tolerable in both processes.

Figure 2:
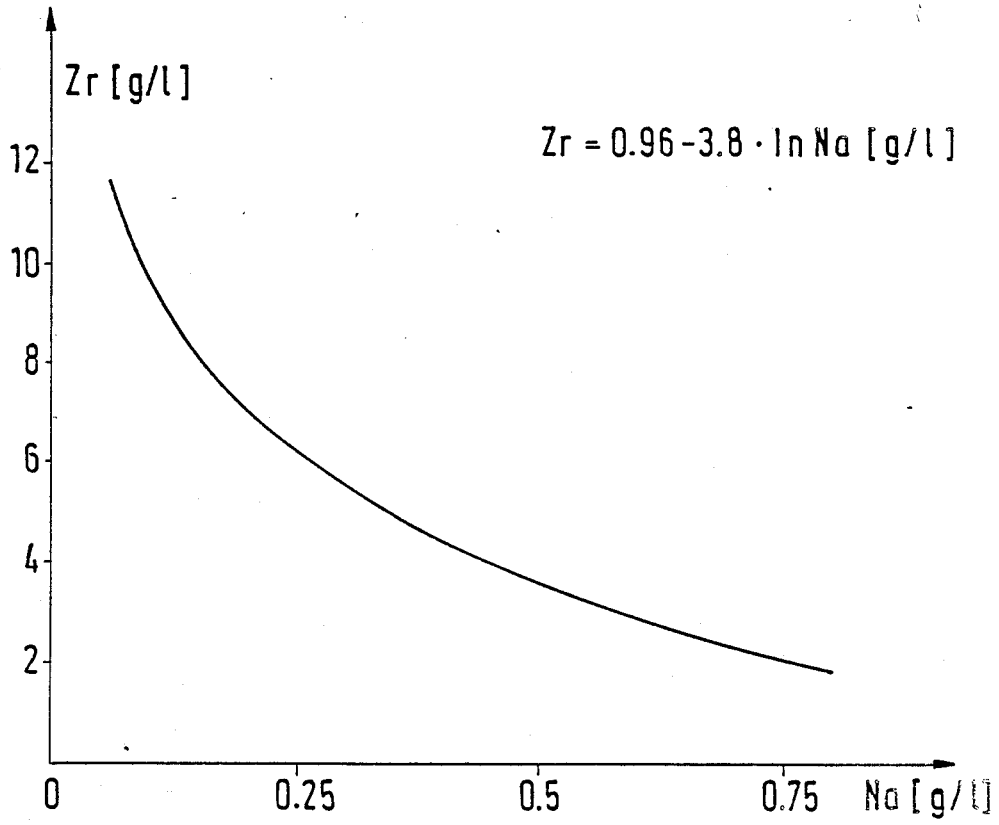
FIG. 2 is a graph in which the residual Zr content of the regenerated pickling solution from which the salt has been removed and which is at 20° C. is plotted against the Na content (laboratory experiments)

But it has surprisingly been found that much more favorable conditions can be achieved if the regeneration is carried out in accordance with the invention. In that case, equilibrium conditions such as are represented in FIG. 2 may be established in the regenerated pickling solution. Whereas under such conditions the Zr content is inversely proportional to the Na content, the former will be much lower than the contents which are required for a saturation with Zr in the pickling solution (see FIG. 1).

It has been found that when Na is added in an amount of up to 1.5 moles per mole of Zr in the process in accordance with the invention, the Na:Zr mole ratio in the precipitated salt will always be about 1.2. In that region, an increase of the mole ratio will result in a precipitation of Zr at a higher rate and in a higher residual Na content. This means that an enriching of the residual Na content in the regenerated pickling solution can be avoided if Na is added in such an amount that the mole ratio based on the amount of Zr to be precipitated will always be 1.2.

In the process in accordance with the invention a salt having the sum formula $Na_{1.2}ZrF_{5.2}$ will be formed in two stages.

By the addition of an Na compound at an elevated temperature and an optional formation of NaF in the pickling solution to be regenerated, compounds which are poorer in Na and have an Na:Zr sum mole ratio below 1.2 will be precipitated first. As the temperature is decreased, the tendency to precipitate compounds richer in Na will increase too, but this will not result in a formation of new crystals, but the compounds whose Na content is lower will be transformed in part to compounds which are richer in Na by an addition of NaF. In that second partial stage of the precipitating operation, the compounds which are poorer in Na and have initially been formed in a large amount serve as precipitants for the residual NaF. The residual Na content can be controlled by a suitable control of the amount in which the Na compound is added. Finally, a salt is obtained in which the Na:Zr ratio is about 1.2. For purposes of calculation, that salt may be described as a mixture of 20 mole percent $Na_2ZrF_6$+80 mole percent $NaZrF_5$. Whereas the lower Na content of the regenerated pickling solution involves also Zr contents which are much higher than those which were previously regarded as an optimum, the initial Zr content is less critical, in fact, than the dissolving capacity of the regenerated pickling solution, i.e. the difference between the final Zr content $Zr_E$ after the regeneration and the initial Zr content $Zr_A$ obtained when the dissolving capacity has been exhausted, i.e., before the regeneration. Since the aforementioned zirconium difference increases as the Na content decreases, the process in accordance with the invention is desirably carried out with a Na content which is much lower and a Zr content which is correspondingly higher than is contemplated, e.g. in U.S. Pat. No. 4,330,342.

Figure 3:
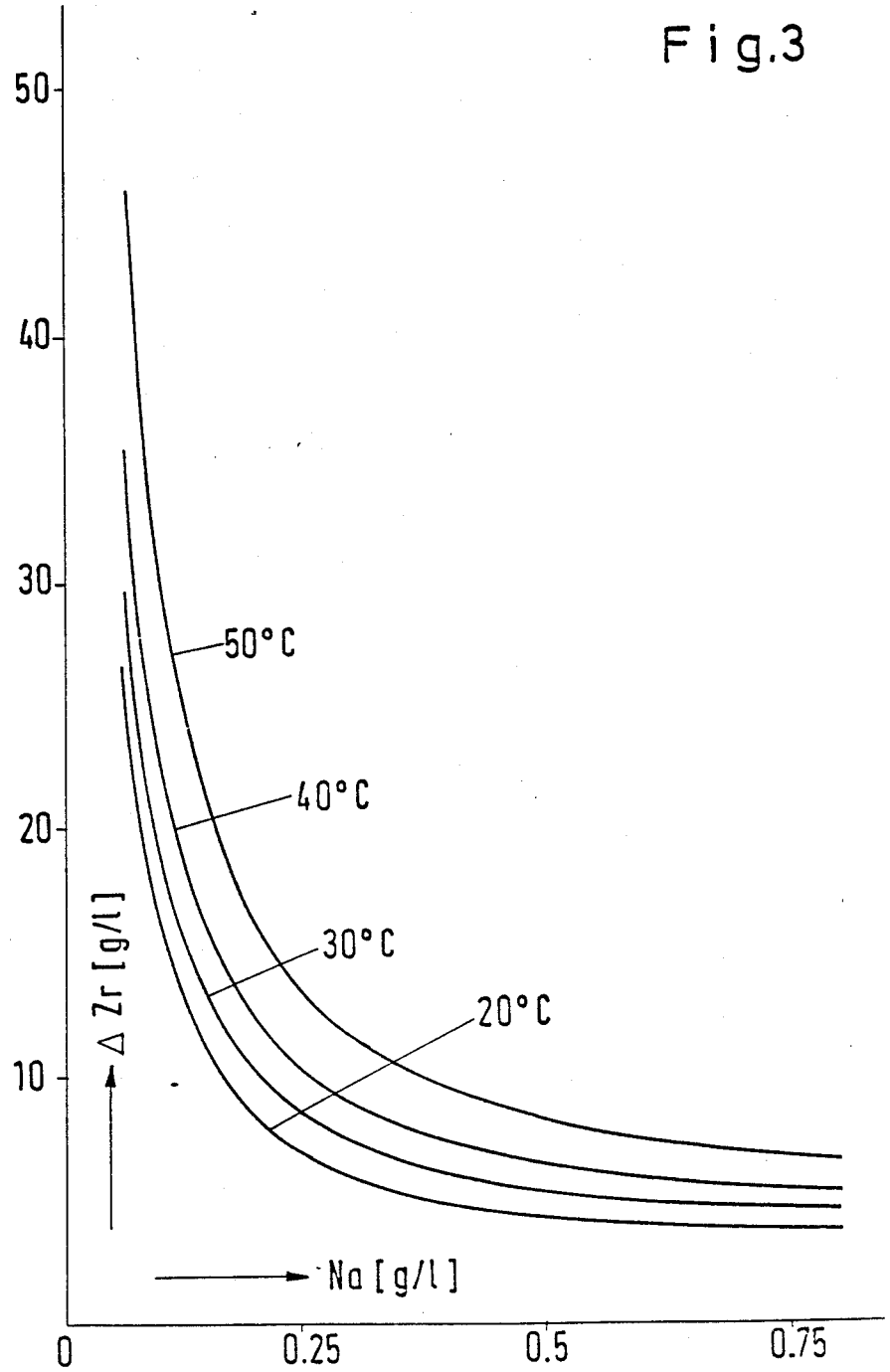
FIG. 3 is a graph in which the Zr dissolving capacity of the regenerated pickling solution is plotted against the Na content and the temperature.

In FIG. 3, the dissolving capacity for Zr, i.e. the difference between the values of FIG. 1 and FIG. 2, is plotted against the Na content and the pickling temperature. It is apparent that dissolving capacities of 4 to 30 g/l can be adjusted in the preferred range of 0.1 to 0.6 g/l Na and that the regenerated pickling solution will always contain less than 10 g/l Zr. In that manner, the above-described disadvantages of the known processes can be overcome in that uncontrolled precipitations during the pickling cycle are revented and a Na:Zr ratio is used which is only about 20% higher than the theoretical minimum of 1, which cannot be achieved in practice.

In a trial operation on a commercial scale, it has been found that the Zr solubilities in the regenerated pickling solution may be much higher than the values which had been determined in the laboratory (up to about 20 g/l Zr depending on the temperature and the composition of the pickling solution) because such supersaturation is relatively stable and will decrease only under intense precipitating conditions (stirring, addition of salt). This means that the reloadability of a regenerated pickling solution with Zr may be higher by up to 20 g/l Zr than is indicated by the calculated differences between the values apparent from FIGS. 1 and 2 and FIG. 3. The Zr contents which can be obtained in a given commercial plant can be determined by a regular analytical examination of the pickling solution. A decreasing Na content will indicate the beginning of the precipitation of the NaZrF salt. The corresponding Zr content represents the limiting value which should not be exceeded.

In the process in accordance with the invention the Zr content which is associated with the desired final $Na_E$ content is determined by the equation $$Zr_E = B - 3.8 \ln Na_E$$

wherein B is between 0 and 5.

This takes into account that it is rarely possible in commercial practice to adjust conditions as exactly as in laboratory or pilot plant experiments. For instance, the $HNO_3$ and HF contents may vary, the accuracy of the metering of the Na-containing precipitant may be subject to fluctuations, the stirring and cooling conditions (of pilot plants) cannot be exactly established in commercial plants and residual salt cannot be removed as completely as in the laboratory. Owing to these and other influences, the Na and Zr contents of the regenerated salt solution may differ from the values apparent from FIG. 2. That deviation may be from −1 to +4 g/l Zr.

For a compensation of such deviations, a range from 0 to 5 is provided for B. The concrete value for a given plant and a given embodiment of the process can be determined empirically. As a result of suitable measurements, the theoretical curve shown in FIG. 2 may be replaced by one which is applicable to the concrete case.

The following examples are presented for a further explanation of the process in accordance with the invention:

EXAMPLE 1

A new plant was used to regenerate the first charge of a spent pickling solution. The latter obviously contained no Na. It amounted to about 22 $m^3$ and contained 39 g/l Zr, 250 g/l $HNO_3$ and 5 g/l HF. It was strengthened with concentrated nitric acid to provide 26.5 $m^3$ of a solution containing 317 g/l $HNO_3$, 4 g/l HF and 32 g/l Zr. That solution was to be regenerated to provide a regenerated pickling solution which contains 0.1 g/l Na.

A final content $Na_E$ of 0.1 g/l has a final content $Zr_E$ of 9.75 g/l associated with it. Thus all values required for a determination of the Na demand have been provided, which in that case corresponds to 6.78 g/l.

When 45% caustic soda solution is used as a precipitant, 694 kg caustic soda solution will be required to regenerate the entire charge of 26.5 $m^3$. The HF demand was also determined as a check. It amounts to $6.78 \times (20/23) = 5.9$ g/l. Because the spent pickling solution contains only 4 g/l HF, it had to be strengthened by an addition of at least $(5.9-4) \times 26.5 = 50.4$ kg. For operational reasons, the solution was strengthened to contain 8 g/l HF.

The pickling solution which had thus been pretreated was heated to 55° C. before caustic soda solution in the calculated amount was added with intense stirring while the temperature rose to 67° C. While the mixture was stirred and was circulated by a pump, it was cooled in a heat exchanger to 35° C. and was subsequently filtered. About 2100 kg moist salt corresponding to 1400 kg dry salt, were obtained, which had a Na:Zr mole ratio of 1.18, as well as 26.2 $m^3$ filtrate composed of

| | |
|---|---|
| 10 g/l Zr | 2 g/l HF |
| 0.2 g/l Na | 309 g/l $HNO_3$. |

The Zr content compared with FIG. 2 is higher by about 3 g/l. Makeup HF was added to the filtrate so that it complied with the requirements for pickling. The filtrate was then available as regenerated pickling solution.

EXAMPLE 2

When the regenerated pickling solution produced in Example 1 had been used in the pickling plant and had been strengthened with HF and $HNO_3$ as required, 29 $m^3$ spent pickling solution were obtained, which contained 325 g/l $HNO_3$, 12 g/l HF, 0.2 g/l Na and 28 g/l Zr. For a determination of the values which are specific to the plant used and may be represented by a curve which corresponds to that of FIG. 2, a much higher final content $Na_E$ of 0.6 g/l was used for the second precipitation. A demand of 885 kg caustic soda solution having a concentration of 45% was determined to be required to precipitate the zirconium. An addition of HF before the precipitation was not necessary. The filtrate obtained after processing as described in Example 1 contained 0.9 g/l Na and 4 g/l Zr, which means that the Zr content was about 2.5 g/l higher than is apparent from FIG. 2.

EXAMPLE 3

A regeneration which was comparable to Examples 1 and 2 and in which a predetermined final content $Na_E$ of 0.4 g/l was used resulted in a regenerate that contained 0.6 g/l Na and 5 g/l Zr, which was higher by about 2 g/l than is apparent from FIG. 2.

EXAMPLE 4

From the results of Examples 1 to 3, the following equation can be derived as a basis for the operation of the plant employed:

$$Zr_E = 3.5 - 3.8 \ln Na_E \text{ (g/l)}$$

In consideration thereof, a plurality of charges were regenerated as in Examples 1 to 3. A final content $Na_E$ of 0.4 g/l was determined in each case. Results which are well reproducible were obtained in all cases, namely $Na_E$=0.4 g/l (±0.1 g/l)

$Zr_E$=7 g/l (±1 g/l)

The mole ratio in the precipitated salt was

Na/Zr=1.2 (±0.04)

The precipitated salts could conveniently be filtered and dewatered so only a small amount of adhering acid was carried along with the salt that was removed.

EXAMPLE 5

27.5 $m^3$ pickling solution which contained 0.15 g/l Na, 31 g/l Zr, 316 g/l $HNO_3$ and 9 g/l HF were to be regenerated. A final content $Na_E$ of 0.1 g/l was desired. In accordance with the plant-specific equation determined in Example 4, a demand of 593 kg 45% caustic soda solution was added. No makeup HF and makeup $HNO_3$ were added before the precipitation.

The temperature of the spent pickling solution amounted to 38° C. before the precipitation and increased to 49° C. during the precipitation. The mixture was then cooled to 19° C. with stirring and was subsequently filtered. About 1800 kg moist salt, corresponding to 1300 kg dry salt were obtained, which had a Na:Zr mole ratio of 1.20, as well as about 27.2 $m^3$ filtrate composed of

| | |
|---|---|
| 12 g/l Zr | 4 g/l HF |
| 0.11 g/l Na | 307 g/l $HNO_3$ |

EXAMPLE 6

In the procedure of Example 4, spent pickling solutions containing 0.4 g/l Na (±0.05 g/l) and 20 to 25 g/l Zr were regenerated. Instead of 45% caustic soda solution, the following precipitants were employed: 5% caustic soda solution
30% caustic soda solution
45% aqueous $NaNO_3$ solution
solid NaF
solid $Na_2SO_4 \times 10\ H_2O$ Results which are comparable with those of Example 4 were obtained in all cases.

EXAMPLE 7

In another process in accordance with Example 4, a precipitation carried out at 30° C. resulted in a temperature rise of the pickling solution to 38° C. A slimy salt was precipitated, which could be filtered and dewatered only with difficulty. Even a heating of the suspension to 60° C. and a subsequent cooling did not result in an improvement. The time required to separate the salt by filtration was about 10 times longer and the resulting filter cake contained much more adhering moisture (about 60% instead of 35% before). The above-mentioned disadvantages were avoided in the regeneration of the next charge in that the precipitation temperature was raised above 35° C.

EXAMPLE 8

In another processing, the pickling solution to be regenerated was heated to 75° C. before the precipitation and caustic soda solution was used as a precipitant. The temperature increased to about 85° C. Favorable results as in FIG. 4 were obtained when the solution was cooled to 39° C.

EXAMPLE 9

When makeup HF and makeup $HNO_3$ had been added to the filtrate obtained in Example 5, said filtrate was used as a regenerated pickling solution for pickling and was subsequently available as a spent pickling solution amounting to 29.0 $m^3$ and having the following composition:

| | |
|---|---|
| 41 g/l Zr | 8 g/l HF |
| 0.1 g/l Na | 316 g/l $HNO_3$ |

A sodium content of 0.1 g/l was desired after the regeneration. An Na demand of 8.6 g/l was calculated in accordance with the plant-specific equation. The resulting HF demand amounted to 7.5 g/l and was already contained in the pickling solution to be regenerated so that a makeup was not required.

964 kg 45% caustic soda solution were added. After the precipitation, about 3200 kg moist salt, corresponding to 2100 kg dry salt were obtained, which had an Na:Zr mole ratio of 1.19, as well as about 28.4 $m^3$ filtrate composed of:

| | |
|---|---|
| 11.5 g/l Zr | 1 g/l HF |
| 0.1 g/l Na | 308 g/l $HNO_3$ |

After an addition of makeup HF and makeup $HNO_3$ that filtrate is available as a regenerated pickling solution without need for other measures.

It is apparent from the examples that the use of the regenerating agents in the amounts proposed in accordance with the invention and the other measures taught by the invention permit the production of a regenerated pickling solution which can be adjusted to a desired residual Na content and a desired dissolving capacity for Zr, which depends on said residual Na content in adaptation to the requirements of a given pickling process.

The above-described disadvantages of known processes will be avoided, particularly an uncontrolled precipitation resulting from excessive residual sodium contents. Besides, the process is highly economical because the amount of precipitant which is required only slightly exceeds the amount required for achieving the stoichiometric Na:Zr mole ratio of 1, which cannot be achieved on a commercial scale.

We claim:

1. A process for regenerating a spent pickling solution laden with $ZrF_4$ having been used to treat zirconium or a zirconium alloy, said pickling solution containing:
5 to 60 g/l HF;
150 to 400 g/l $HNO_3$;
0.06 to 1.0 g/l Na; and
5 to 50 g/l Zr
which comprises the steps of:
(a) analyzing a charge of the pickling solution to be regenerated for its initial contents of HF, $HNO_3$, Na and Zr, hereinafter designated $HF_A$, $HNO_{3A}$, $Na_A$, and $Zr_A$;

(b) selecting a final Zr and a desired in the regenerated pickling solution, hereinafter respectively designated $Zr_E$ and $Na_E$;

(c) determining amounts required of sodium, hereinafter designated $Na_Z$, to be added to the spent pickling solution according to the formula:

$$Na_Z=0.3(Zr_A-Zr_E)+(Na_E-Na_A)$$

(d) supplying additional HF to the spent pickling solution to be regenerated so that a resulting total amount of HF in the pickling solution to be regenerated is sufficient to transform a sodium compound added during step (f) to NaF;

(e) heating the pickling solution to be regenerated to a temperature of 35° to 75° C.;

(f) following step (e) adding the sodium compound to the spent pickling solution to be regenerated according to the equation in step (c);

(g) precipitating in the spent pickling solution to be regenerated a salt having a sum formula $Na_{1.2}ZrF_{5.2}$ and separating the precipitate from the now regenerated pickling solution; and (h) conducting said process as a batch process.

2. The process defined in claim 1 wherein the $Na_E$ is selected and wherein the corresponding final content $Zr_E$ is calculated as $Zr_E=1-3.8 \ln Na_E$ according to step (c).

3. The process defined in claim 1 wherein the $Na_E$ is selected and wherein the corresponding final content $Zr_E$ is calculated as $Zr_E=B-3.8 \ln Na_E$ according to step (c), wherein B is a value between 0 and 5, which is to be determined when the process is started.

4. The process defined in claim 1 wherein the spent pickling solution to be regenerated contains 5 to 40 g/l HF.

5. The process defined in claim 1 wherein the spent pickling solution to be regenerated contains 0.06 to 0.8 g/l Na.

6. The process defined in claim 1 wherein during step (e) the spent pickling solution to be regenerated is heated to 35° to 65° C.

7. The process defined in claim 1 wherein during step (e) the spent pickling solution to be regenerated is heated to 45° to 55° C.

8. The process defined in claim 1 wherein according to step (g) the amount of the spent pickling solution which is removed with the precipitated salt amounts to 1 to 5% of the amount of regenerated pickling solution.

9. The process defined in claim 1 wherein according to step (d) the spent pickling solution to be regenerated is made up to a full charge batchwise after each recycle by again providing said original determined required amounts of $NHO_3$ and $H_2O$ as well as HF.

10. The process defined in claim 1 wherein according to step (b) the selected final content $Na_E$ in the spent pickling solution to be regenerated amounts to 0.06 to 0.9 g/l.

11. The process defined in claim 10, wherein the selected final sodium to be regenerated amounts to 0.08 to 0.8 g/l.

12. The process defined in claim 10, wherein the selected final sodium content $Na_E$ in the spent pickling solution to be regenerated amounts to 0.2 to 0.6 g/l.

13. The process defined in claim 1 wherein according to steps (d) and (f) the sodium compound is NaOH.

14. The process defined in claim 1 wherein according to steps (d) and (f) an aqueous solution of 10 to 50% NaOH is used as a regenerating agent.

15. The process defined in claim 1 wherein after step (f) and before step (g) the temperature of the regenerated pickling solution is cooled below 35° C.

16. The process defined in claim 15 wherein the temperature of the regenerated pickling solution is cooled below 30° C.

17. The process defined in claim 15 wherein the temperature of the regenerated pickling solution is cooled to 15° to 30° C.

18. The process defined in claim 15 wherein the precipitated salt is separated by terminating stirring of the regenerated pickling solution, permitting the precipitated salt to settle, and after an adequate waiting time pumping clear regenerated pickling solution from the sedimented salt.

19. The process defined in claim 18 wherein the regenerated pickling solution is pumped from the sedimented NaZrF compound after 2 to 72 hours.

20. The process defined in claim 1 wherein according to steps (d) and (f) the sodium compound added to the spent pickling solution to be regenerated is a fluorine-free compound other than NaOH.

21. The process defined in claim 20 wherein the fluorine-free sodium compound other than NaOH is selected from the group consisting of sodium nitrate, sodium acetate and sodium carbonate.

22. The process defined in claim 1 wherein additional $HNO_3$ is added to the spent pickling solution to be regenerated prior to step (f).

23. The process defined in claim 1 wherein following step (g) additional HF, additional $H_2O$ or both are added to the regenerated pickling solution.

24. The process defined in claim 1 wherein according to step (g) precipitation of the NaZrF compound is accelerated by adding precipitated NaZrF compound obtained from a previous charge.

25. The process defined in claim 24 wherein the precipitated salt obtained from a precious charge is added in an amount of 10 to 20 g/l.

26. A process for regenerating a spent pickling solution laden with $ZrF_4$ having been used to treat zirconium or a zirconium alloy, said pickling solution containing:

5 to 60 g/l HF;
150 to 400 g/l $HNO_3$;
0.06 to 1.0 g/l Na; and
5 to 50 g/l Zr which comprises the steps of:

(a) analyzing a charge of the pickling solution to be regenerated for its initial contents of HF, $HNO_3$, Na and Zr, hereinafter designated $HF_A$, $HNO_{3A}$, $Na_A$, and $Zr_A$;

(b) selecting a final Zr and Na desired in the regenerated pickling solution, hereinafter respectively designated $Zr_E$ and $Na_E$;

(c) determining amounts required of sodium, hereinafter designated $Na_Z$, to be added to the spent pickling solution according to the formula:

$$Na_Z=0.3(Zr_A-Zr_E)+(Na_E-Na_A)$$

said sodium being added in the form of NaF;

(d) supplying additional HF to the spent pickling solution to be regenerated so that a resulting total amount of HF in the pickling solution to be regenerated is sufficient to transform a sodium compound added during step (f) to NaF;

(e) heating the pickling solution to be regenerated to a temperature of 35° to 75° C.;

(f) following step (e) adding the NaF to the spent pickling solution to be regenerated according to the equation of step (c);

(g) precipitating in the spent pickling solution to be regenerated a salt having the sum formula $Na_{1.2}ZrF_{5.2}$ and separating the precipitate from the now regenerated pickling solution; and (h) conducting said process as a batch process.

* * * * *